US006244994B1

(12) United States Patent
Tilberis

(10) Patent No.: US 6,244,994 B1
(45) Date of Patent: Jun. 12, 2001

(54) METHOD OF EXERCISING THE UPPER BODY BY TENSION AND TORSION

(76) Inventor: Andrew Tilberis, 152 E. 82nd St., New York, NY (US) 10028-1803

( * ) Notice: Subject to any disclaimer, the term of this patent is extended or adjusted under 35 U.S.C. 154(b) by 0 days.

(21) Appl. No.: 09/047,782

(22) Filed: Mar. 25, 1998

Related U.S. Application Data

(62) Division of application No. 08/731,693, filed on Oct. 17, 1996, now Pat. No. 5,769,764.

(51) Int. Cl.[7] ..... A63B 21/00
(52) U.S. Cl. ..... 482/91; 482/124; 482/907
(58) Field of Search ..... 482/148, 131, 482/91, 121, 114, 907; 602/18

(56) References Cited

U.S. PATENT DOCUMENTS 4,466,610 * 8/1984 Israel ..... 482/91
5,498,218 * 3/1996 Proctor et al. ..... 482/10
5,857,948 * 1/1999 Barnett ..... 482/140

* cited by examiner

*Primary Examiner*—Jerome W. Donnelly
(74) *Attorney, Agent, or Firm*—Pitney, Hardin, Kipp & Szuch LLP

(57) ABSTRACT

An exercising device includes a non elastic strap that fits around the upper back, shoulders and upper arms of a user. The ends of the strap are coupled with a hand grip. The strap may form part of an upper torso body garment. In use, the upper torso is twisted and the handgrips pushed while tensioning upper body muscles and arms.

21 Claims, 5 Drawing Sheets

FIG. 5
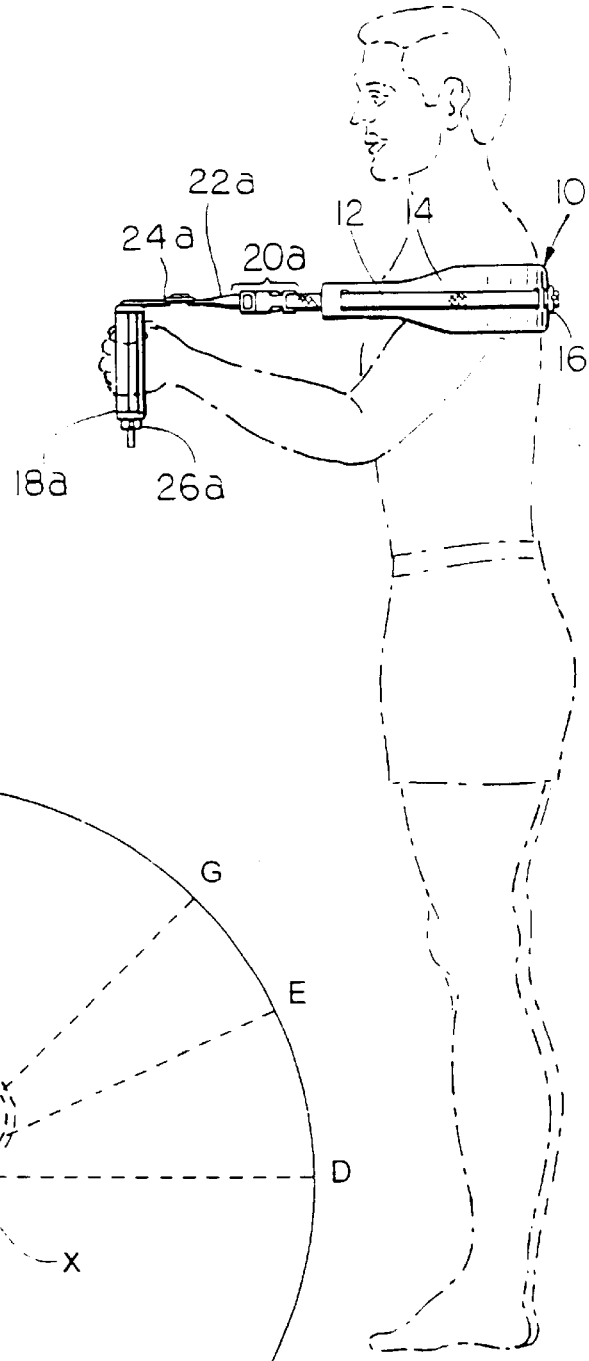
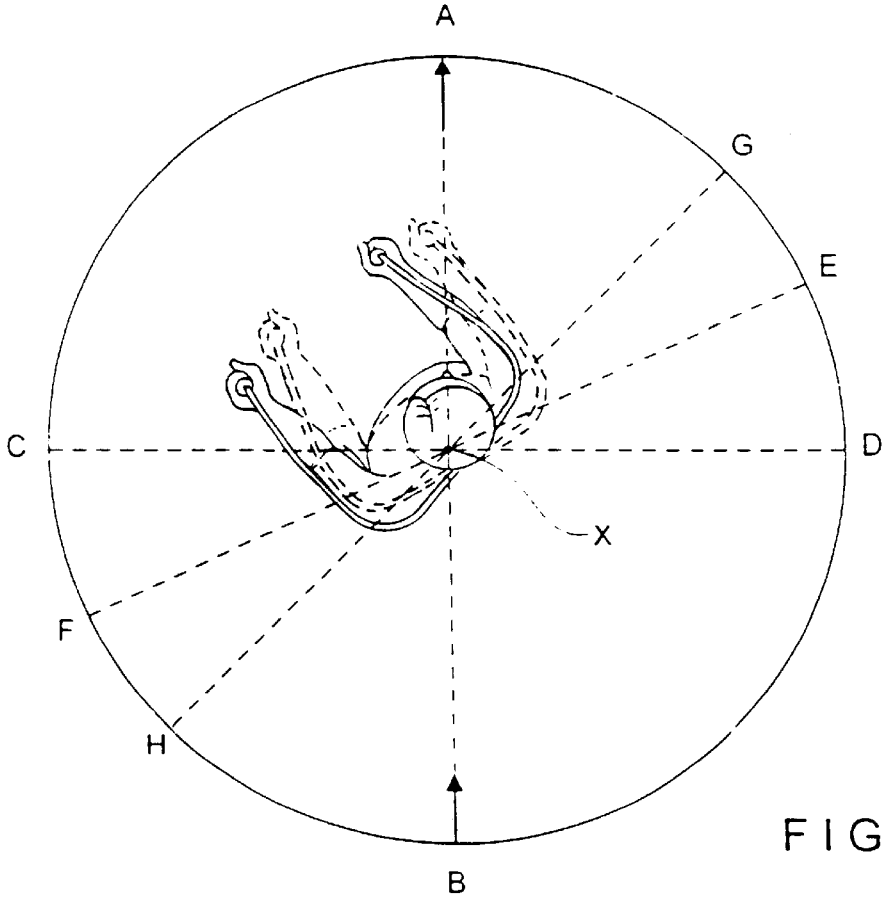
FIG. 6

METHOD OF EXERCISING THE UPPER BODY BY TENSION AND TORSION

CROSS REFERENCE TO RELATED APPLICATIONS

This is a division of U.S. application Ser. No. 08/731,693 filed on Oct. 17, 1996, now U.S. Pat. No. 5,769,764.

BACKGROUND OF THE INVENTION

1. Field of the Invention

The present invention relates generally to an exercise device and, in particular, to an exercising device that advantageously requires the user to tense the upper body muscles only to an extent determined by the user.

2. Description of the Prior Art

The prior art discloses many forms of exercising devices for the upper torso in which elastic parts or straps require the user's arms to move away from the body against or counter to a biasing force.

In U.S. Pat. No. 5,518,481 a continuous elastic cord is adapted to be looped around a user's shoulder. Handgrips at each cord end are grasped and the upper body is exercised against the biasing resistance of the cord.

In U.S. Pat. No. 4,961,573 a boxing exercise harness is worn on the upper torso and includes handgrips, a pulley system and interposed elastic straps. The user performs a boxing routine and an elastic force provided by the straps opposes the arm movements.

In U.S. Pat. No. 5,433,688, elastic cords having a handgrip at each end are attached to a waist belt. The user's arm and upper body are moved against the resistance of the elastic cords.

In U.S. Pat. No. 5,473,435, the user wears a belt to which is attached a pair of swivel assemblies having coupled thereto counterforce units that provide an elastic biasing force for performing arm curls.

In UK Patent No. 434,067, shoulder straps extend from a belt and have coupled thereto springs having foot engaging loops for developing the muscles of the arm, chest and back.

In U.S. Pat. No. 4,911,439 an elastic cord is looped around the shoulders of a user and handles attached to the cord are grasped. The user exercises by stretching the cord.

In U.S. Pat. No. 4,993,705, an expandable strap having wrist cuffs is attached to a vest. Arm movements exert a pulling force on the strap.

Exercising devices of the foregoing types are oftentimes complicated but, more importantly, require constant expanding and contracting of the user's arms thereby causing arm weariness and the magnitude of tension is normally not dictated by the user but the parameters of the elastic member.

SUMMARY OF THE INVENTION

A principal object of the present invention is to provide an exercising device with no elastic parts so that the arms of the user do not move away from the body axis and the tension amount offered by the device is determined by the user.

Another object is to provide an exercising device of the foregoing type which, when used, tenses the upper torso as a result of pushing on handles while twisting the upper body.

A further object is to provide an exercising device of the foregoing type which may be used during walking, running, standing or sitting.

The exercising device of the present invention benefits all upper-body muscle groups effectively and quickly. It increases tone, endurance, strength and flexibility. It is intended as an exerciser that is serious but fun to use. It provides a simultaneous work-out to accompany running, jogging or walking. Thus, can be used outdoors but indoors, as well on a treadmill. Moreover, it puts no undue strain on joints or muscles.

The exercise device of this invention balances the equation between lower body expenditure of energy with that of the upper body, by equaling a torsion or twist repetition for each step of a run, walk or jog. The normal withering of the upper body that follows serious running or walking is not only eliminated but reversed. Upper body muscle increases and serious fitness and muscle tone ensue.

These and other objects are attained by a static exercising device that advantageously employs a non-elastic strap that fits around the outside of a user's upper back, shoulders and upper arm. By pushing equally with both hands against the strap with grasped handles and then a twisting motion of the upper body, pressure or load is placed on the back. This pressure is preferably spread over a large area; and, it is additionally preferred that the strap does not move or slide. Handles at each strap end when grasped by the user remain parallel and at a fixed distance from the axis of the body during the twisting motion. Thus, the user tenses the arms and upper body muscles to an extent determined by the user while twisting the upper body in a fashion simulating a boxing motion during walking, running, standing or sitting.

Other objects and advantages will become apparent from the following detailed description which is to be taken in conjunction with the accompanying drawings.

BRIEF DESCRIPTION OF THE DRAWINGS

FIG. 5 is a side view of the user with the exercising device as shown in FIGS. 3 and 4;

FIG. 6 is a top plan view of the user with the exercising device going through a twisting motion while tensing the muscles of the upper body;

DETAILED DESCRIPTION OF THE PREFERRED EMBODIMENTS

Figure 1:
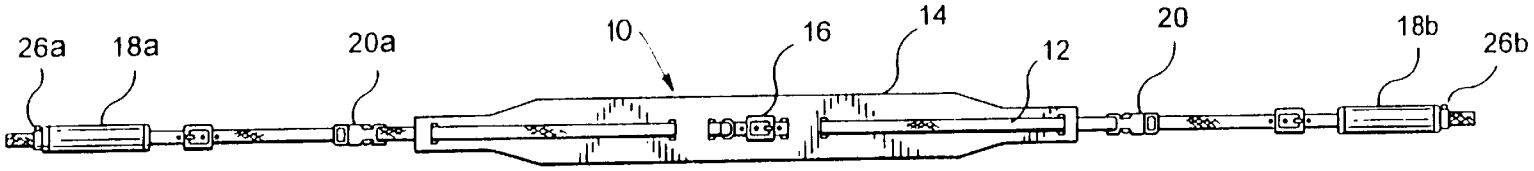
FIG. 1 is a top plan view of an embodiment of an exercising device incorporating the teachings of the present invention.
Figure 2:
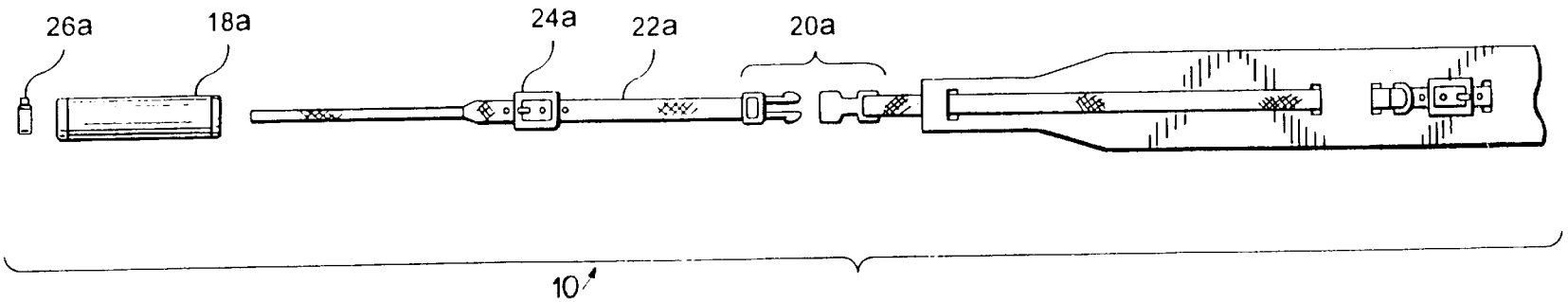
FIG. 2 is an enlarged exploded plan view of the exercising device with certain parts broken away and removed.

In the drawings, an exercising device 10 of the present invention includes a non elastic strip 12 suitably interlaced with a wider non elastic band or web 14 which is designed to fit around the upper back, shoulders, and upper arms of a user and spreads pressure and load over a larger area. The widest part of the upper skeletal structure (the outside of the humerus bone, of the upper arm and scapula of the upper back, with their incasing muscles), provides the ideal locations for the exercise device of this invention and thereby distinguishes it from the cited prior art. By holding sustained tension (contraction) of these muscle groups throughout a run or walk the exercise device of this invention helps to overcome what is believed to be a medical fact that skeletal muscle is capable of contracting rapidly and powerfully only for short periods of time. The strap 12 may be of one piece or adjustable by means of the conventional, adjustable belt buckle 16. The ends of strap 12 are detachably connected to handles or handgrips 18*a*, 18*b* by means of releasable buckles 20*a*, 20*b* of conventional construction. Between handles 18*a*, 18*b* and buckles 20*a*, 20*b* may be non elastic strap sections 22*a*, 22*b* which may be adjustable in length by the conventional belt buckle 24*a*, 24*b*. The ends of the strap sections 22*a*, 22*b* distal the buckles 20*a*, 20*b* may be releasably secured to the respective handles 18*a*, 18*b* by means of a collar and threaded bolt assemblies 26*a*, 26*b*. Obviously other known means of releasable securement and belt adjustability may be utilized.

Figure 3:
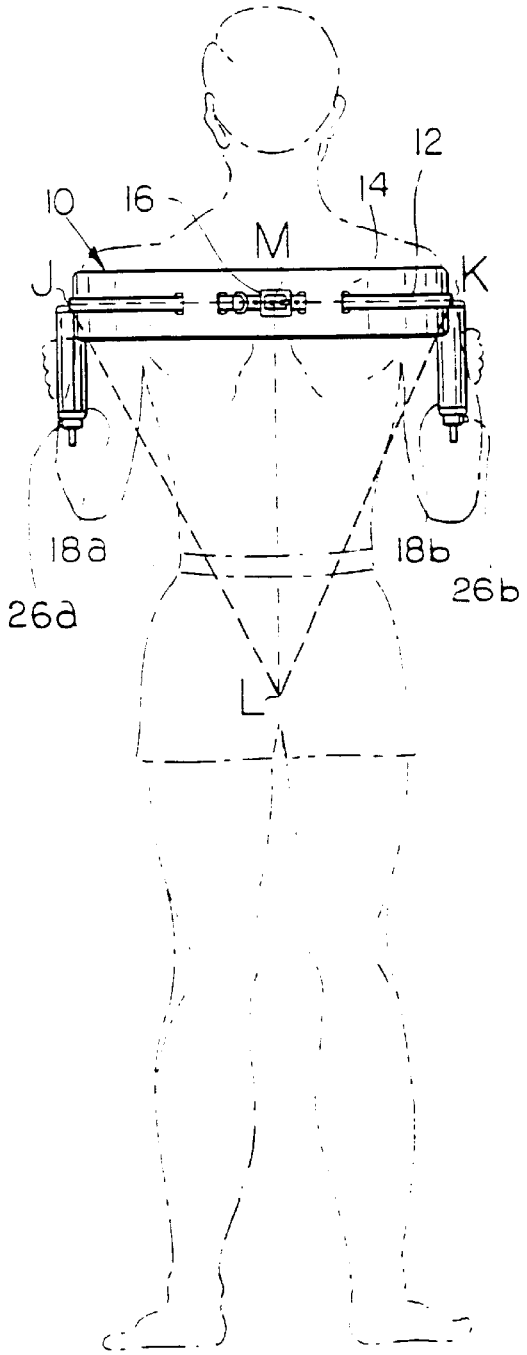
FIG. 3 is a rear view of a user, shown in phantom, with the non elastic strap of the exercise device around the upper back, shoulders, and upper arms of the user with handles grasped.
Figure 4:
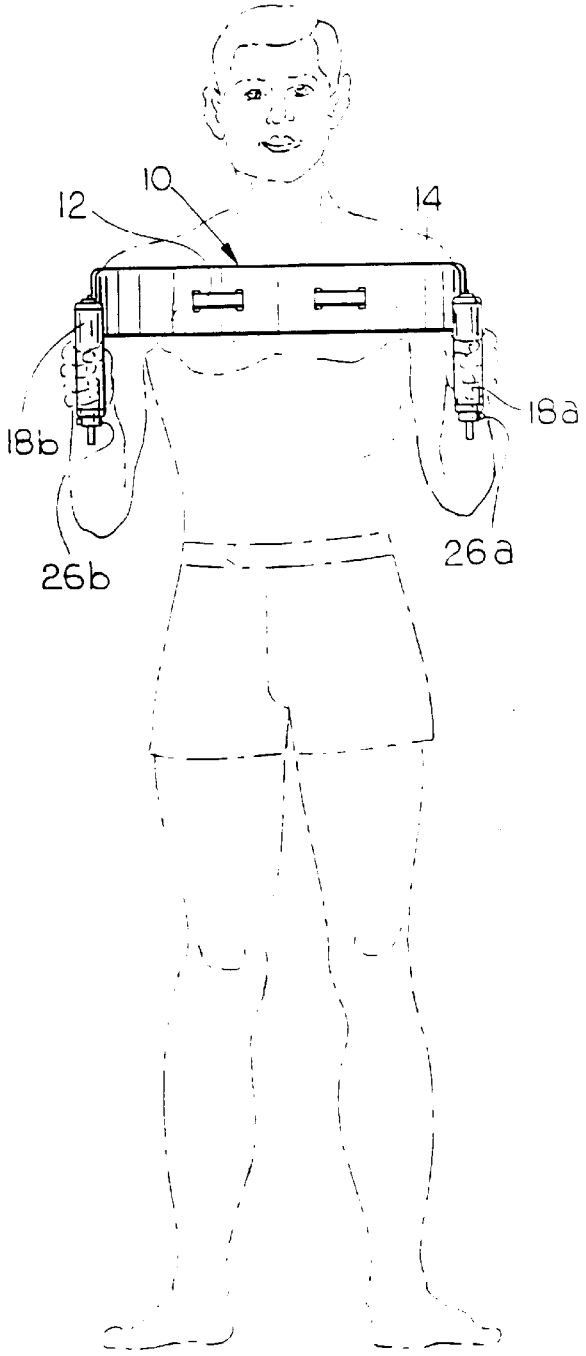
FIG. 4 is a front view of the user with the exercising device as shown in FIG. 3.

In use, the exercising device 10 is placed around the outside of the user's back, shoulders and upper arms as shown in FIGS. 3, 4 and 5. With the handles grasped as shown the muscles of the upper body are tensed simply by pushing against the handles equally. The upper body is twisted as shown in FIG. 6. During this twisting motion, it is significant that the handles remain parallel and at a fixed distance from the axis of the body during the twisting motion. Obviously, the degree of torsion or twisting is a variable as represented by the various diameters illustrated in FIG. 6; and, this motion may take place during walking, running, standing or sitting. In this regard, A-B is the direction of travel;

E-F represents shoulder travel during normal running or walking at approximately 25-degrees to even less movement around the body's vertical axis (x);

G-H represents increased swivel to about 45- degrees or more;

C-D is the body at 90-degree or normal to the direction of travel.

With respect to G-H, the movement represents a 45-degree forward rotation and a 45-degree reverse rotation of the upper torso and arms, in unison. This is accomplished whilst forward motion is in progress through walking, jogging or running. The head and pelvis should always face in the direction of travel whilst the torso swivels through 90-degrees for each step taken. This has the effect of a high repetition exercise for the neck and upper trapezium; the abdominals, upper and lower; the obliques; and the muscles of the lower back.

The sequence of use of the exercise device of this invention may be explained as follows. Left foot forward; shoulders and upper body "zone" twist to the left. Right foot forward; upper body "zone" twists to the right. The user is in complete control of grip, pull-tension, strength of rotation, number of twists and twist groupings. Once it becomes apparent that the body can be rotated around its own axis whilst forward motion is maintained, (the head and lower body are constantly facing in the direction of travel) then the more advanced potential can flow safely.

The twisting provides the "torsion" effect. The "tension" is provided by the exercise device itself against which resistance is obtained by its location across the upper back and the pull of both hands. The arms, pectorals, deltoids and abdominals are in tension or flexed; to a degree determined by the user and they may be held in this state throughout the run or walk or relaxed again at the dictates of the user.

Therefore, a workout is both "aerobic" and "anaerobic". It is a high "fat" burn with simultaneous muscle building properties. This makes the exercise device of this invention unique from the described prior art. It is also stress free and fun to use which makes it revolutionary. Because of the tension-torsioner's non-stress and fun aspect, it can be used by all age groups up to and including the elderly.

At JK of FIG. 3, the widest part of the upper torso, maximum torsion (twist) can be applied against the resistance of the pelvis and the lower torso. Because the triangle of the upper body JKL is pivoted on point L (lower spine) minimum force or effort is required. This gives the user a greater range of comfortable angles around the vertical or longitudinal axis of the torso.

Also JMK are the furthest points of the upper torso from the pelvis L, therefore the greatest tension (and contraction) of the upper body muscles can occur. With the exercise device of this invention in place and upper body flexed maximum leverage can be applied against the lower body, while it pursues its own activity, running, walking or jogging. Any other position from M towards L reduces the angle and therefore the effectiveness.

Figure 7:
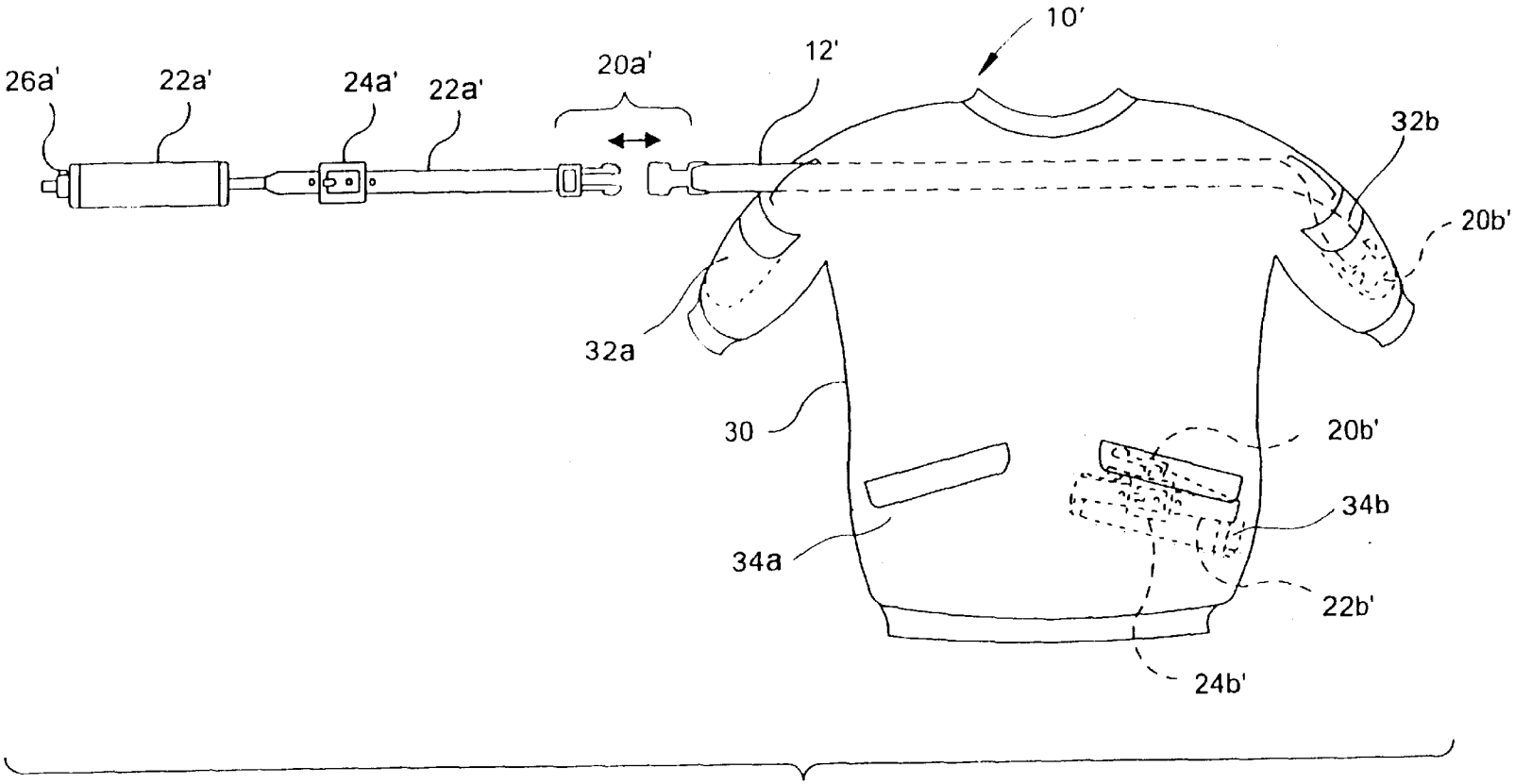
FIG. 7 is a front view of an upper body garment having attached thereto an embodiment of an exercising device of this invention with certain parts removed.

In FIG. 7, an embodiment of the inventive exercise device 10, is illustrated in which strap 121 forms part of an upper torso garment 30. Like parts are noted with an accompanying prime. Pockets 32*a*, 32*b* with closure straps or velcro strips on the sleeves may conveniently receive the female part of the buckles 20*al* and 20*bl*. Pockets 34*a*, 34*b* with closure flaps or velcro strips on the garment front may conveniently receive strap sections 22*al*, 22*b*', and handles 18*al*, 18*bl*. The exercise device 101 is used in the same fashion as the device of FIGS. 1–6.

The exercise device 10 and the form fitting tension suit 30, are both predicated on a previously undiscovered physiological principle. In particular, the increased blood flow, and concomitant proteins, chemicals and the like, necessary for muscle fiber growth and tone, can and does occur while the muscles are in continuous tension. Previously, it had been held that "exercise" in the form of repetitive muscle contraction and relaxation, using such systems as weights, isometrics, aerobics, anaerobics and the like, was the only manner of "pumping" the necessary quantity of blood to the given muscles to grow them. The continuous tension principle awaits scientific validation, but the inventor hereof is confident that his theory and observational data will hold up to rigorous examination and measurement.

An important distinction needs to be made between muscle tension and muscle contraction. The action of simply touching the fingers of one's right hand to his right shoulder contracts the biceps and extends the triceps of his right upper arm. When he then extends his right arm downwardly to his side, the reverse occurs. In the relaxed state, minimal effort is required to perform these acts. The two muscle groups employed in these simple acts are the biceps and the triceps. The biceps and the triceps are referred to as "prime-movers" and "antagonists". The biceps "contract" to initiate the right hand being brought up to one's shoulder, and the triceps "contract" to straighten the arm to one's side. Minimal "tension", however, is required. If one was to hold increasing amounts of weight in his right hand and perform the same motion of bringing his hand, with the weight, to his shoulder, the amount of "tension" required would increase in both the biceps and the triceps in direct proportion to the increasing weight. The increase would stop at such a time that the weight became too large for his muscle tension, that is, strength and/or endurance, to lift. The simple act of touching one's shoulder with one's fingers may be characterized as 0% of tension for one's upper arm muscles, and the act of lifting the heaviest weight may be characterized as 100% tension for one's upper arm muscles.

For most non-professional athletes, short periods of repetitive exercise are used to raise this muscle "tension" above the 50% level perhaps two to three times per week. This exercise, which may last one to two hours per session, is then followed by the rest of the waking day where the muscles are allowed to return to their "relaxed" state of between 10% to 20% of "tension". With age or over the course of years, the result is a self-defeating pattern. The proof that this is a self-defeating pattern is that more effort is required by the older "exerciser", who feels that he can never achieve his youthful strength, risks muscle, tendon, joint or worse injury if he pushes too hard.

The exercise device 10 and the exercise protocol, more fully set forth below, will together train "voluntary" muscles to assume an "involuntary" state. The upper body muscles will achieve at least 80% "tension" during use of the exercise device and will sustain this level of "tension" throughout the waking day. There is no age barrier to achieving this level of "tension". The regimen is simple and easy to perform and has a homogenous effect on the entire body, whether one is, for example, walking to work, watching television, eating a meal, driving a car or attending a concert. The body remains "tensioned", and, contrary to medical opinion, this tautness improves blood-flow and well-being. With scientific measurements to follow, it has been suggested by the medical profession that benefits could accrue for these persons suffering from, for example, myasthenia gravis, Parkinson's disease, osteoporosis, not to mention similar symptoms experienced by astronauts returning to Earth after a long exposure to weightlessness. A further benefit of the exercise device 10 is an increase of testosterone production.

As evidence that the foregoing effects and advantages of the present invention can be realistically achieved, one need only observe the muscles of the human neck. At four to six weeks of age, the human neck muscles cannot sustain the weight of an infant's head.

However, from about this age until death, the human neck muscles remain sufficiently "tensioned" to hold one's head erect for the entire day. There is no histological difference between the muscles of the human neck and the other human skeletal muscles.

The "Tension-Torsion Protocol" will be described below. The Protocol is intended as an adjunct to the use of the exercise device 10 as a running, jogging or walking supplement. The Protocol is intended for use at home while, for example, watching television, reading or listening to the radio. The Protocol can be used aerobically and anaerobically or merely anaerobically. In order to follow the Protocol, one need only use the exercise device 10 with a clock that has a second hand.

Aerobic/Anaerobic

1. With the exercise device 10 held in the position described above, (across the upper back with the hands held just below shoulder height in front of the body and legs slightly apart in the standing position), the upper body, abdominal, pectoral and arm muscles and the like are tensioned. The whole upper body is to swivelled or torsioned to the left. Simultaneously, the lower body is swivelled to the right, the left leg is bent, and the left heel is raised, leaving the ball of the left foot on the ground. The upper body is then swivelled to the right with the lower body and right leg tensioning to the left. With practice, the forgoing motions produce a flowing, aerobic rhythmic motion, while maintaining the upper body in anaerobic tension. The aerobic/anaerobic regimen is generally best performed for approximately fifteen to thirty minutes.

Anaerobic

Each of the stations described below of each "tension" position is preferably held for approximately one minute. Familiarity with the anaerobic regimen and its resultant increase in strength and endurance will permit the holding time to be increased incrementally. It is important that as many muscles as possible, especially the abdominal muscles, be held in tension throughout each tension position. The degree of "tension" will also increase with one's increasing strength. One practicing the anaerobic regimen should maintain his normal breathing pattern.

1. Overhead Press (a) When clasping the folded exercise device 10 in both hands above one's head with the arms straight up, hands outstretched slightly wider than the width of the shoulders, the user pulls outwardly to tension his muscles. This position is best held for approximately one minute.

(b) While maintaining the outward pull of all of the upper body muscles in tension, the user bends his arms, lowering them to the back of his head with his shoulders back. The exercise device 10 should thus be positioned above the user's back. This position is then best maintained for approximately one minute.

(c) While maintaining continuous tension, the user lowers the exercise device 10 behind his neck to his shoulders. The user should attempt to prevent touching his shoulders or neck. It is preferable to maintain this position for approximately one minute.

Figure 8:
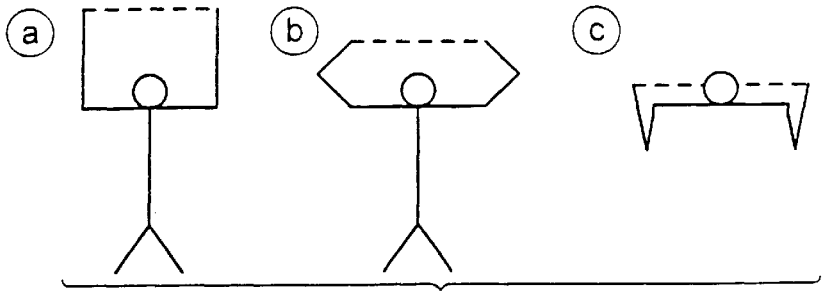
FIG. 8 illustrates the three positions of an overhead press routine using the exercise device of the present invention.

FIG. 8 illustrates the three foregoing positions with the exercise device 10 shown in phantom.

2. Horizontal Press (a) With the user's arms outstretched in front of his standing body, the user clasps the folded exercise device 10 in each hand at a width slightly wider than the width of his shoulders. The user then pulls outwardly to tension all of his upper body muscles. This position should be held for approximately one minute.

(b) The user then bends his arms to a horizontal position while continuing to pull outwardly and maintain tension in the upper body to bring the exercise device 10 to about one-half the distance to his chest. This position should be held for approximately one minute.

(c) Finally, while maintaining tension in the upper body, the user then brings the exercise device 10 to nearly touching his chest, again holding this position for approximately one minute.

Figure 9:
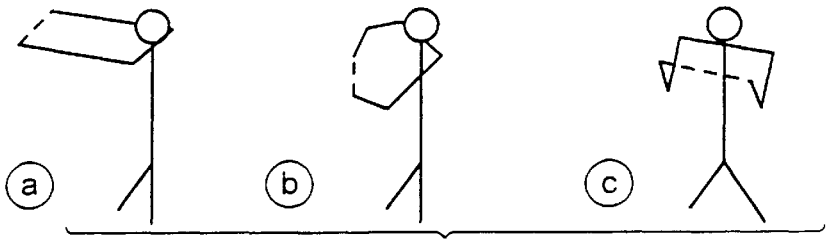
FIG. 9 illustrates the three positions of a horizontal press routine using the exercise device of the present invention.

FIG. 9 illustrates the three foregoing positions with the exercise device 10 shown in phantom.

3. Front Lift (a) While clasping the folded exercise device 10 with his hands approximately three inches apart and straight down in front of his body and his palms facing his body, the user pulls outwardly to tension the upper body. It is preferable for the user to maintain this position for approximately one minute.

(b) While maintaining tension of the upper body muscles and keeping his shoulders lowered, the user lifts his arms to between the bottom of and half of the height of his rib cage. This position is preferably maintained for approximately one minute.

(c) The user then raises his hands to his chin and raises his elbows above his shoulders, which should be maintained in the lowered position. During the foregoing routine, the user should maintain his head in an erect position and breathe in a normal manner. It is preferable to maintain this position for approximately one minute.

Figure 10:
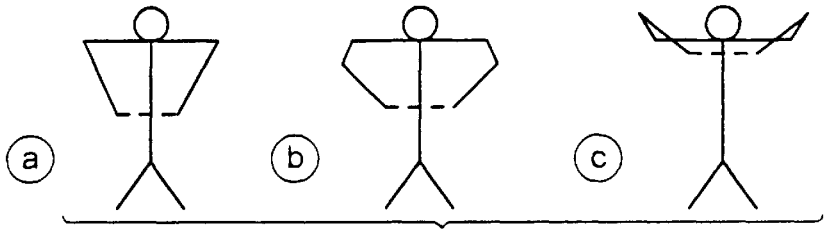
FIG. 10 illustrates the three positions of a front lift routine using the exercise device of the present invention.

FIG. 10 illustrates the three foregoing positions with the exercise device 10 shown in phantom.

4. Front Curl (a) While clasping the folded exercise device 10 with his hands facing away from the body and positioned apart slightly wider than the width of his shoulders and with his hands straight down, the user pulls outwardly and tensions his upper body muscles. This position is preferably maintained for approximately one minute.

(b) The user then curls his arms upwardly with his forearms parallel to the ground. The user should preferably maintain this position for approximately one minute.

(c) The user then curls his arms upwardly toward his chin while continuing to pull outwardly and maintain his upper body muscles in tension. It is preferable for the user to maintain this position for approximately one minute.

Figure 11:
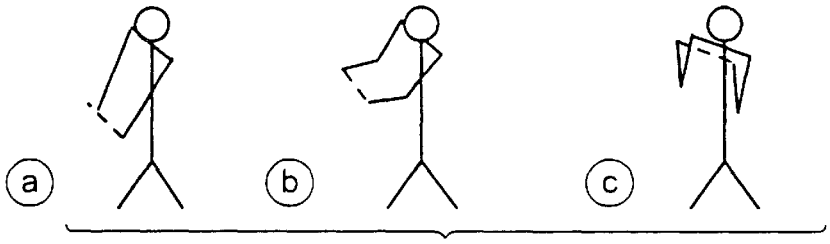
FIG. 11 illustrates the three positions of a front curl routine using the exercise device of the present invention.

FIG. 11 illustrates the three foregoing positions with the exercise device 10 shown in phantom.

5. Front Tension Curl—Left Hand (a) The user clasps both of the handles of the exercise device 10 through the openings with his left hand. With his right hand, the user clasps the handles on the outside just below his left hand. With his legs slightly apart, the user torsions his upper body to the right and straightens his arms downwardly, positions his right hand on the outside of his right thigh and positions his left hand across his torsioned body. The user's left hand should be positioned at this point through the handles of the exercise device 10 with his left palm facing upwardly. The user's right hand will be facing toward his left and pulling downwardly. As the user's left hand is pulling upwardly, the user should tension his upper body muscles against the counter-pull of his hands. This position is best maintained for approximately one minute.

(b) While maintaining his body in tension and torsion, the user raises his forearms to a horizontal position, keeping his upper arms vertical and to one side of the torso. It is preferable for the user to maintain this position for approximately one minute.

(c) While continuing to pull upwardly with his left hand and downwardly with his right hand, the user curls his left hand to his chin. The user should preferably maintain this position for approximately one minute.

Figure 13:
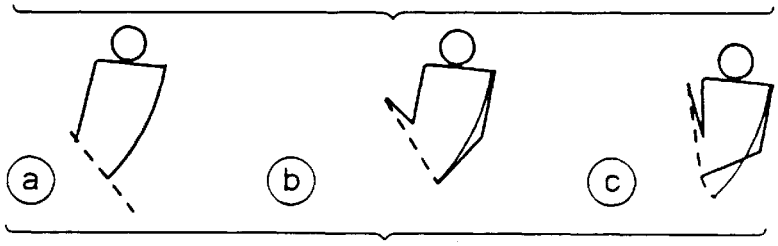
FIG. 13 illustrates the three positions of a front tension curl routine using the exercise device of the present invention.

FIG. 13 illustrates the three foregoing positions with the exercise device 10 shown in phantom.

6. Front Tension Curl—Right Hand

The user should repeat the Front Tension Curl—Left Hand described above but reversing the movements of his left and right hands.

7. Abdominal Crunch (a) The user positions the exercise device 10 in the "classic" upright position around his upper back, holding the handles apart at a width approximately equal to the width of his shoulders, in front of his body and out a height just below the height of his shoulders. The user should tension his upper body by pulling forwardly against the resistance of his back and then crunch his upper body forwardly to approximately 25 degrees from vertical. It is preferable to maintain this position for approximately one minute.

(b) The user should further crunch his upper body to approximately 50 degrees from vertical and maintain this position for approximately one minute.

(c) The user should still further crunch his upper body to approximately 90 degrees from vertical. That is, the upper body should become approximately horizontal to the ground with the legs vertical and straight. This position is preferably maintained for approximately one minute. It will be appreciated that this final crunching position is part of an advanced exercising regimen and may only be achieved gradually.

Figure 12:
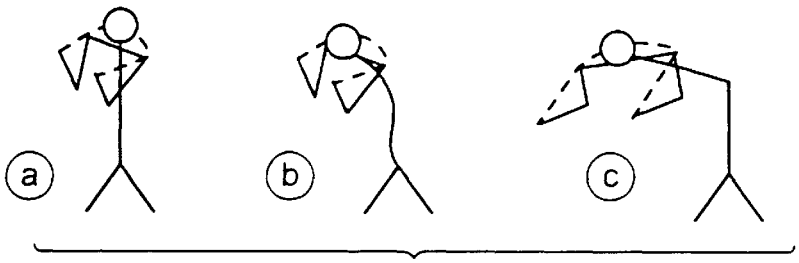
FIG. 12 illustrates the three positions of an abdominal crunch routine using the exercise device of the present invention.

FIG. 12 illustrates the three foregoing positions with the exercise device 10 shown in phantom.

The user should maintain breathing in a normal manner throughout the exercise regimen. Further, the user should attempt to tension his stomach muscles during all of the foregoing routines. If the user should experience a feeling of "pins-and-needles", strain or the like, he should relax his tensioned muscles but retain his current position.

The exercise device of this invention may be incorporated in a full line of sportswear (T-shirts, tank-tops, sweatshirts, track-suits, etc.). The straps and harness may be stitched and may be integral with the garment and as explained pockets/pouches internal and external can carry all attachments and accessories and the universal buckles or clip connectors.

The accessories are intended to be light so that they may be conveniently carried by the user. This will give the flexibility of breaking a run/walk for a static workout using different attachments before returning to complete one's run.

With the addition of varied and weighted handgrips and universal clip or buckle connectors one can therefore structure a more demanding workout. Thus the several aforenoted objects and advantages are most effectively attained. Although several somewhat preferred embodiments have been disclosed and claimed herein, it should be understood that this invention is in no sense limited thereby and its scope is to be determined by that of the appended claims.

What is claimed is:

1. A method of exercising the upper body by tension and torsion comprising the steps of:

placing an inelastic strap having opposed ends and a handle at each end around the upper back, shoulders and upper arms of a user's body having an axis;

gripping each handle at the ends of the strap;

tensioning the upper body muscles to any extent desired while gripping the handles and applying pressure on the upper body, shoulders and upper arms;

twisting the upper body about the axis of the user's body; and maintaining the handles substantially parallel to the axis of the user's body and the same distance therefrom during the twisting of the upper body.

2. The method of exercising in accordance with claim 1, wherein the sequence of exercising is left foot forward and shoulders and upper body twist to the left, then right foot forward and upper body twists to the right, and the foregoing sequence is repeated under the complete control of the user.

3. A method of exercising the upper body by tension and torsion, comprising the steps of:

an overhead press routine using an exercise device;

a horizontal press routine using said exercise device;

a front lift routine using said exercise device;

a front curl routine using said exercise device;

a left-hand front tension curl routine using said exercise device;

a right-hand front tension curl routine using said exercise device; and an abdominal crunch routine using said exercise device;

wherein said exercise device comprises a non-elastic strap having opposed ends and handles coupled to and at each of the opposed ends.

4. The method according to claim 3, wherein the overhead press routine comprises the steps of:

(a) tensioning the upper body muscles by pulling outwardly on the exercise device in a folded position by both of the hands above the head with both arm positioned vertically and with the hands outstretched to a width slightly wider than the with of the shoulders;

(b) positioning said exercise device above the back by maintaining tension in the upper body muscles and bending both arms by lowering both arms to the back of the head with the shoulders back; and (c) lowering said exercise device behind the neck to the shoulders while maintaining continuous tension in the upper body muscles.

5. The method according to claim 4, wherein each position after each of the steps (a)–(c) is maintained for approximately one minute.

6. The method according to claim 3, wherein the horizontal press routine comprises the steps of:

(a) tensioning the upper body muscles by pulling outwardly on the exercise device said exercised device being folded and clasped in each hand being outstretched in front of the upper body at a width wider than the width of the shoulders;

(b) bending both arms horizontally to one-half of the distance to the chest while maintaining tension in the upper body muscles; and (c) further bending the arms horizontally to nearly touch the chest with said exercise device while maintaining tension in the upper body.

7. The method according to claim 6, wherein each position after each of the steps (a)–(c) is maintained for approximately one minute.

8. The method according to claim 3, wherein the front lift routine comprises the steps:

(a) tensioning the upper body muscles by clasping said exercise device in a folded position with both hands, the hands being spaced apart at a distance of approximately three inches and being positioned straight downwardly in front of the body, the palms of both hands facing the body;

(b) lifting both arms to a height between the bottom of the rib cage and the middle of the rib cage while maintaining tension in the upper body muscles and while maintaining the shoulders in a lowered position; and (c) raising both hands to the chin and both shoulders above the shoulders while maintaining the upper body muscles in tension, the shoulders lowered and the head in an erect position.

9. The method according to claim 8, wherein each position after each of the steps (a)–(c) is maintained for approximately one minute.

10. The method according to claim 3, wherein the front curl routine comprises the steps of:

(a) tensioning the upper body muscles by clasping said exercise device in a folded position in both hand and pulling outwardly on said exercise device, both hands facing away from the body and being position apart at a width wider than the width of the shoulders, both arms being positioned vertically;

(b) curling both arms upwardly with the forearms in a horizontal position; and (c) curling both arms upwardly toward the chin while continuing to pull outwardly on said exercise device and maintaining tension in the upper body.

11. The method according to claim 10, wherein each position after each of the steps (a)–(c) is maintained for approximately one minute.

12. The method according to claim 3, wherein the left-hand front tension curl routine comprises the steps of.

(a) tensioning the upper body muscles by clasping said exercise device with the left hand through openings of the handles thereof and clasping said handles below the left hand on the outside thereof with the right hand, while simultaneously torsioning the upper body to the right with the legs positioned apart, straightening both arms downwardly, positioning the right hand outside of the right thigh and the left hand across the body, the palm of the left hand facing upwardly, and the right hand facing toward the left and pulling downwardly;

(b) raising both forearms to a horizontal position, positioning the upper arms vertically and to one side of the torso, while maintaining tension and torsion of the upper body muscles;

(c) curling the left hand to the chin while pulling upwardly with the left hand and downwardly with the right hand and while maintaining tension and torsion of the upper body muscles.

13. The method according to claim 12, wherein each position after each of the steps (a)–(c) is maintained for approximately one minute.

14. The method according to claim 3, wherein the right-hand front tension curl routine comprises the steps of:

(a) tensioning the upper body muscles by clasping said exercise device with the right hand through openings of the handles thereof and clasping said handles below the right hand on the outside thereof with the left hand, while simultaneously torsioning the upper body to the left with the legs positioned apart, straightening both arms downwardly, positioning the left hand outside of the left thigh and the right hand across the body, the palm of the right hand facing upwardly, and the left hand facing toward the right and pulling downwardly;

(b) raising both forearms to a horizontal position, positioning the upper arms vertically and to one side of the torso, while maintaining tension and torsion of the upper body muscles;

(c) curling the right hand to the chin while pulling upwardly with the right hand and downwardly with the left hand and while maintaining tension and torsion of the upper body muscles.

15. The method according to claim 14, wherein each position after each of the steps (a)–(c) is maintained for approximately one minute.

16. The method according to claim 3, wherein the abdominal crunch routine comprises the steps of:

(a) tensioning the upper body muscles by pulling forwardly against said exercise device being placed around the back, the handles of said exercise device being held by the hands, which are positioned apart at a width approximately equal to the width of the shoulders and in front of the body at a height below the height of the shoulders;

(b) crunching the upper body forwardly to an angle of approximately twenty-five degrees from vertical while maintaining tension in the upper body muscles;

(c) further crunching the upper body forwardly to an angle of approximately fifty degrees from vertical while maintaining tension in the upper body muscles.

17. The method according to claim 16, wherein each position after each of the steps (a)–(c) is maintained for approximately one minute.

18. The method according to claim 16, further comprising the step of:

(d) further crunching the upper body forwardly to an angle of approximately ninety degrees from vertical while maintaining tension in the upper body muscles, the upper body becoming approximately horizontal and the legs becoming approximately vertical and straight.

19. The method according to claim 18, wherein each position after each of the steps (a)–(d) is maintained for approximately one minute.

20. The method according to claim 3, wherein a normal breathing pattern is maintained during each of the routines.

21. The method according to claim 3, wherein tension in the stomach muscles is maintained during each of the routines.

* * * * *